US006425617B1

(12) United States Patent
Sting et al.

(10) Patent No.: US 6,425,617 B1
(45) Date of Patent: Jul. 30, 2002

(54) GRIPPER MECHANISM FOR DEVICES FOR HANDLING OBJECTS IN THE FORM OF SHEETS OR PLATES, IN PARTICULAR FOR POST PROCESSING MACHINES

(75) Inventors: Martin Sting, Bad Vilbel; Christian Botschek, Rodermark, both of (DE)

(73) Assignee: Pitney Bowes Technologies GmbH, Friedberg (DE)

( * ) Notice: Subject to any disclaimer, the term of this patent is extended or adjusted under 35 U.S.C. 154(b) by 0 days.

(21) Appl. No.: 09/593,626

(22) Filed: Jun. 13, 2000

(30) Foreign Application Priority Data

Jun. 18, 1999 (DE) ..... 199 27 946

(51) Int. Cl.[7] ..... B66C 1/48
(52) U.S. Cl. ..... 294/102.1
(58) Field of Search ..... 294/16, 62, 63.1, 294/67.33, 81.6, 81.62, 101, 102.1, 103.1, 104, 114, 116, 119.1, 901

(56) References Cited

U.S. PATENT DOCUMENTS 4,697,246 A * 9/1987 Zemke et al. ..... 364/563
5,704,246 A * 1/1998 Kruger ..... 73/159
5,823,521 A * 10/1998 Emigh et al. ..... 270/58.06
5,893,595 A * 4/1999 Corbett ..... 294/102.1
5,975,514 A * 11/1999 Emigh et al. ..... 270/58.06

FOREIGN PATENT DOCUMENTS

DE 19739784 A1 9/1997

* cited by examiner

*Primary Examiner*—Robert E. Pezzuto
(74) *Attorney, Agent, or Firm*—George M. Macdonald; Angelo N. Chaclas

(57) ABSTRACT

In a gripper mechanism for devices for handling sheet-like or plate-like articles, particularly for mail-processing machines, simple and reliable setting for the handling of light, thin and also heavy, thick articles can be effected by the use of pivotable gripper claws on the gripper hand provided at the end of a pivotable gripper arm, by virtue of the fact that a plane which is oriented approximately perpendicular to the gripper arm longitudinal axis, and in which the contact area between articles to be handled and a pivotable gripper claw also lies, is at such a distance in the direction of the longitudinal axis of the gripper arm from the pivot axis of this pivotable gripper claw that an additional pivoting moment acts on the latter in the closure direction, generated under the effect of tensile forces which seek to remove the articles to be handled from the gripper claws when these are closed, as a result of which articles of widely varying weight and varying thickness are at all times gripped securely.

6 Claims, 6 Drawing Sheets

GRIPPER MECHANISM FOR DEVICES FOR HANDLING OBJECTS IN THE FORM OF SHEETS OR PLATES, IN PARTICULAR FOR POST PROCESSING MACHINES

TECHNICAL FIELD

The invention relates to a gripper mechanism for devices for handling objects in the form of sheets or plates, in particular for post processing machines.

BACKGROUND ART

Generally known gripper mechanisms of this type, which have been in use for a long time, contain a gripper arm which can pivot about a gripper arm pivoting shaft and can be moved transversely with respect to the movement direction of a transfer chain, which is driven intermittently for example, by means of an appropriate drive, for example a crank drive, to carry out reciprocating pivoting movements. At its free end, the gripper arm is fitted with a gripper hand which has a pair of interacting gripper claws of which, in general, one is designed to be fixed relative to the gripper arm and the other is fitted such that it can pivot relative to the gripper arm. The pivoting gripper claw is moved by means of a claw operating drive against the force of spring means, which hold the gripper claws in the closed position, in specific pivoting positions of the gripper arm in the open position in order to grip either a specific object in the form of a sheet or plate, or a corresponding stack of such objects, and once the gripper claws have closed, to transport them to the transfer chain or else, when this handling process has been completed, to release the relevant object or stack of objects once again so that the compartment on the transfer chain which has now been filled can continue to move with said chain. One known embodiment of a gripper claw operating drive provides an operating lever arrangement which is mounted on the gripper arm such that it can pivot, can be pivoted by means of a claw operating drive apparatus during the pivoting movements of the relevant gripper arm, and is connected via a coupling linkage to the gripper claw which can pivot with play or a clearance which allows a specific opening of the gripper claws against the force of the spring prestressing means regardless of the respective position of the operating lever arrangement. In general, the operating lever arrangements for a plurality of gripper arms which are operated at the same time and are forced to move synchronously in a reciprocating manner are seated on a common operating shaft which is mounted on each of the simultaneously moved gripper arms, and is rotated in a reciprocating manner in specific gripper arm pivoting positions via a slotted guide link, a slotted guide link feeler and a feeler roll lever, which is firmly attached to the operating shaft, in order to operate the respective pivoting gripper claws on the individual gripper arms simultaneously, so that the operating lever arrangements which are seated on the operating shaft move the moving gripper claws to the open position via the individual coupling linkage.

For certain post processing tasks, it is necessary to make up a despatch from enclosures which consist of a sheet or a small number of sheets, and possibly folded sheets, and enclosures which consist of a stack of bound or stapled sheets. In this case, difficulties arise in setting gripper mechanisms of the same type and at processing stations arranged successively along a transfer chain to enclosures of different thickness such that, on the one hand, thin enclosures can be gripped reliably when being handled and a monitoring device provided on the respective gripper mechanism responds correctly in order to record multiple outputs or empty outputs and, on the other hand, when handling thick enclosures, to ensure that the clamping forces during handling are sufficient for the relevant gripper mechanism to apply the required forces when drawing the enclosure from the stack and to introduce the necessary acceleration forces to the enclosure, without losing it. The setting effort required to do this is in some cases high with known gripper mechanisms.

DISCLOSURE OF THE INVENTION

The invention is thus intended to achieve the object of refining a gripper mechanism having the features of the precharacterizing clause of claim 1 such that it can be set easily and reliably to handle both light, thin objects and thick, heavy objects.

According to the invention, this object is achieved by the characterizing features of claim 1. Advantageous refinements and developments are the subject matter of the claims but are dependent on claim 1, whose content hereby expressly forms part of the description without having to repeat the wording in detail here.

One particular embodiment of the gripper mechanism of the type specified here can be dismantled with a few actions for servicing and repair. The settings made are maintained on the gripper mechanism under the influence of reaction forces in operation even if adjustable parts on the gripper mechanism are fixed with comparatively low clamping forces.

BRIEF DESCRIPTION OF THE DRAWINGS

An exemplary embodiment will be described in more detail in the following text with reference to the drawings, in which.

DETAILED DESCRIPTION OF THE INVENTION

Figure 1:
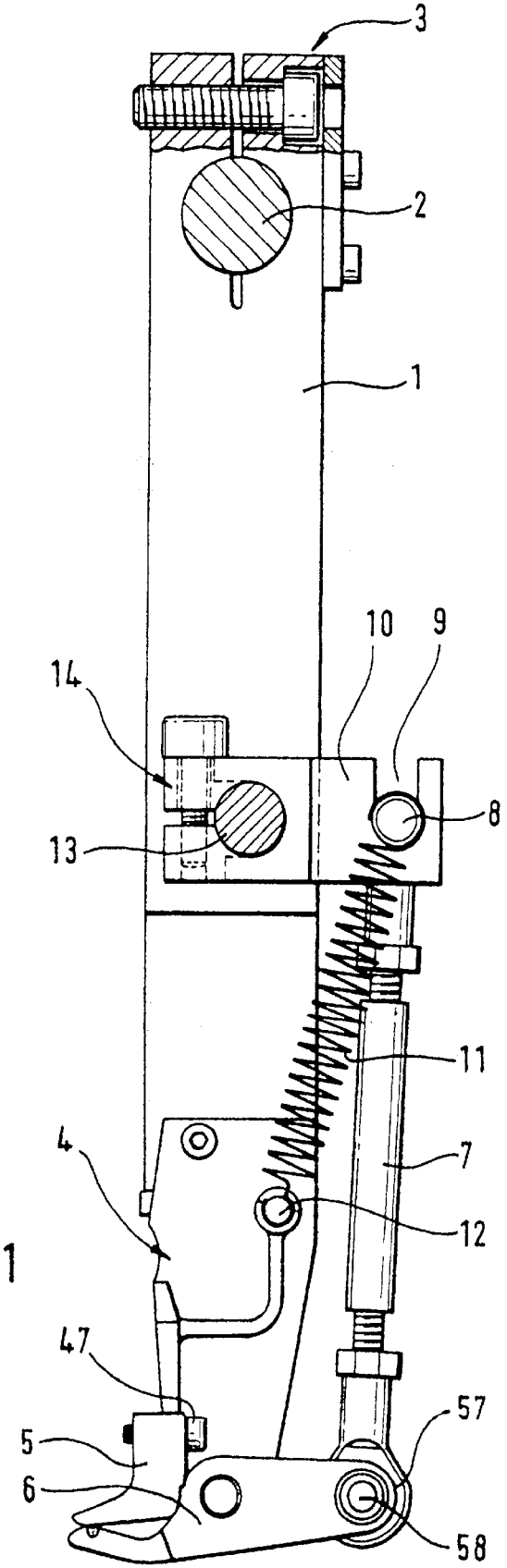
FIG. 1 is a side view of a gripper arm of a gripper mechanism in accordance with an embodiment of the present invention.

In FIG. 1, major parts of a gripper mechanism of the type specified here are shown in a side view, and partially in section. The gripper mechanism includes a gripper arm 1 whose upper end is coupled to a gripper arm pivoting shaft 2 such that they rotate together. In the illustrated embodiment, the gripper arm 1 is clamped onto the gripper arm pivoting shaft 2 by means of a clamping mechanism 3. The gripper arm pivoting shaft can be driven to carry out oscillating rotary movements by means of a pivoting drive, which is not shown in FIG. 1, so that the gripper arm 1 carries out reciprocating pivoting movements about the gripper arm pivoting axis of the pivoting shaft 2, as is known for gripper mechanisms of the general type under discussion here.

At the lower end of the gripper arm 1 there is a gripper hand 4, which is provided with an upper gripper claw 5 fixed firmly to the gripper hand 4, and with a lower gripper claw 6 fitted to the gripper hand 4 such that it can pivot. The claw 6, which can pivot relative to the gripper hand 4, is connected to the lower end of a coupling linkage 7, whose upper end is attached to a shaft 8. The ends of the shaft 8, which project beyond the connecting point of the coupling linkage 7 at the sides, are each inserted into bearing recesses 9, which are approximately U-shaped or in the form of circle sectors, of operating levers 10 of an operating lever arrangement which are located on both sides of the gripper arm, and are also used as tension spring anchor points for helical tension springs 11 which are stretched to further spring anchor points on both sides of the gripper arm 1. The further spring anchor points are indicated at 12 in FIG. 1 and are located on the gripper hand 4.

The operating levers 10 are mounted on a gripper claw pivoting shaft 13, for which purpose each of the operating levers 10 is provided with a clamping apparatus, which is indicated schematically at 14 in FIG. 1. The gripper claw pivoting shaft 13 is mounted in the gripper arm 1 such that it can rotate. If there are a number of gripper mechanisms of the type specified here alongside one another in workstations arranged successively along a transfer chain in a post processing machine, then the gripper claw pivoting shaft 13 for a plurality of gripper mechanisms is provided jointly and is in each case mounted in the gripper arms 1 such that it can rotate.

Apart from the operating levers 10, a slotted-link feeler lever with a slotted link feeler roll is mounted on the gripper claw pivoting shaft 13. The slotted link feeler roll interacts with a slotted guide link during the pivoting movements of the gripper arm 1, this slotted guide link being fixed to the framework. These details, however, are not shown in FIG. 1. Pivoting movements of the slotted link feeler lever 15 anticlockwise about the axis of the gripper claw pivoting shaft 13 likewise result in the operating levers 10 being pivoted anticlockwise and the shaft 8 and the coupling linkage 7 being raised in the process, so that the pivoting gripper claw 6 is opened against the prestressing force of the helical tension springs 11 in order to release objects to be handled which are clamped in between the gripper claws of the gripper hand 4, or to receive such objects, which are then clamped in by means of the gripper claws.

The slotted bearing recesses 9 in the operating levers 10 result in the operating levers 10 being connected with play and via the coupling linkage 7 to the pivoting gripper claw, and this play allows the gripper claws to open to a certain extent against the force of the prestressing means irrespective of the position of the operating levers 10 and irrespective of the instantaneous operating position of the gripper arm, in order that objects of different thickness can be clamped in between the gripper claws 5 and 6.

Figure 4:
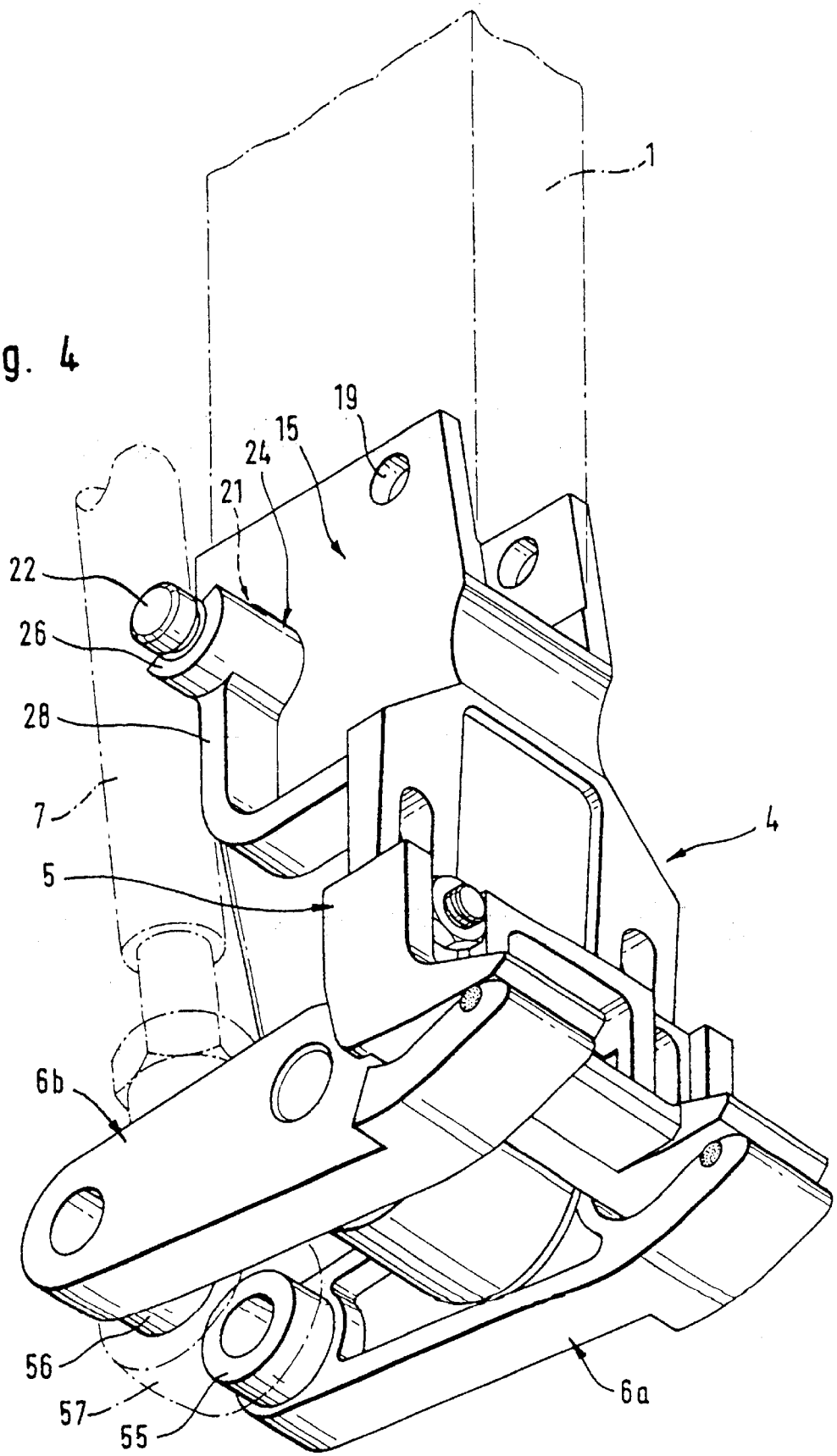
Figure 5:
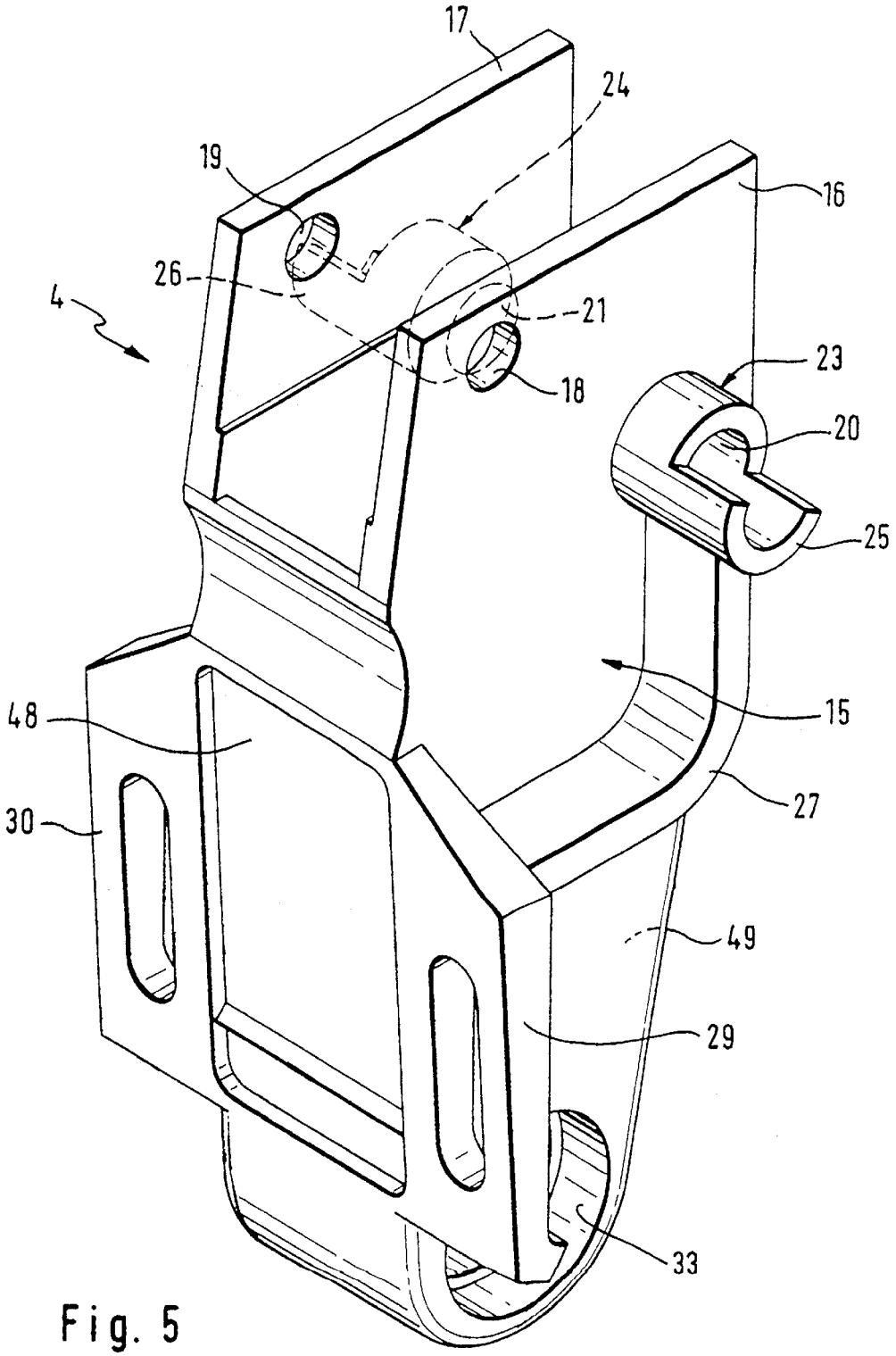
FIG. 5 is a perspective view of the gripper hand housing.

As can be seen particularly clearly in FIG. 5, the gripper hand 4 contains a bearing housing 15, which is connected to the gripper arm 1, is open at the top before being assembled, is essentially in the form of a box and has side walls 16 and 17 which are connected to one another by a front wall 48 and a rear wall 49. The bearing housing 15 is manufactured from a tough, high-strength plastic and is designed as a casting. In an upper region, projecting beyond the front wall 48 and the rear wall 49, the side walls 16 and 17 are provided with coaxial holes 18 and 19, and 20 and 21, although the hole 21 can be seen only in the illustration in FIG. 4. The holes 18 and 19, and 20 and 21 are used to attach the gripper hand 4 to the lower end of the gripper arm 1, which is provided with appropriate transverse holes for this purpose. While a fastening screw is pushed through the holes 18 and 19 and the associated transverse hole in the gripper arm 1 and is secured by a nut, a pin 22 which is provided with annular grooves at its outer ends is pushed through the holes 20 and 21 and the corresponding transverse hole in the gripper arm 1, and its outer ends project at the sides out of the gripper hand 4 and form the further spring anchor points 12 mentioned above, which will be described in more detail in the following text.

Sleeves 23, 24 which surround the holes 20 and 21, respectively and are coaxial with respect to them project at the sides from the side walls 16 and 17, and are integrally formed on the respective associated side wall 16 or 17. The sleeves 23 and 24 each have attachments 25 and 26, respectively, which are in the form of circular cylindrical sectors and whose axial length is dimensioned such that the annular grooves provided on the pin 22 just remain freely accessible when the pin 22 is pushed through the holes 20 and 21 and through the transverse hole in the gripper arm. When the helical tension springs 11 are stretched from corresponding annular grooves in the shaft 8 to the spring anchor points 12, that is to say to the end annular grooves at the ends of the pin 22, then the spring eyes of the helical tension springs 11 at the same time act as stops interacting with the attachments 25 and 26 to fix the pin 22 in a symmetrical position in the gripper hand 4. Thus, all that is necessary for removing the gripper hand 4, is to detach the helical tension springs 11 from the further spring anchor points 12, to push the pin 22 through the sleeves 23 and 24 out of the holes 20 and 21 and out of the transverse hole in the gripper arm 1, and, furthermore, to detach the screw connection which passes through the holes 18 and 19 and the corresponding transverse hole in the gripper arm 1, so that the gripper hand 4 can be removed from the gripper arm 1.

It should also be mentioned that the pin 22 is passed through a fitting transverse hole in the region of the gripper arm 1, which is generally in the form of an aluminum part, and forces exerted on the further spring anchor points 12 by the helical tension springs are thus not supported on the plastic material of the sleeves 23 and 24, but are absorbed by the metallic gripper arm 1.

The strength of the bearing housing 15 of the gripper hand 4 is also increased by means of angled webs 27 and 28 which are fitted integrally on the side walls 16 and 17 and on the sleeves 23 and 24.

Attachment lugs 29 and 30, which are located at the sides approximately at the level of the front wall 18 and are provided with elongated holes, project from the side walls 16 and 17 of the bearing housing 15. The thickness of these attachment lugs 29 decreases in the radial direction away from the pivoting axis of the gripper arm pivoting shaft 2. The attachment lugs 29 and 30 thus taper as the distance from the gripper arm pivoting shaft 2 increases.

Finally, the bearing housing 15 of the gripper hand 4 is provided at its lower end with bearing holes to hold and support gripper claw shaft parts. The axis of the bearing holes is oriented parallel to the gripper arm pivoting axis and parallel to the axis of the gripper arm pivoting shaft 13. The bearing holes are denoted generally by 33.

Figure 3:
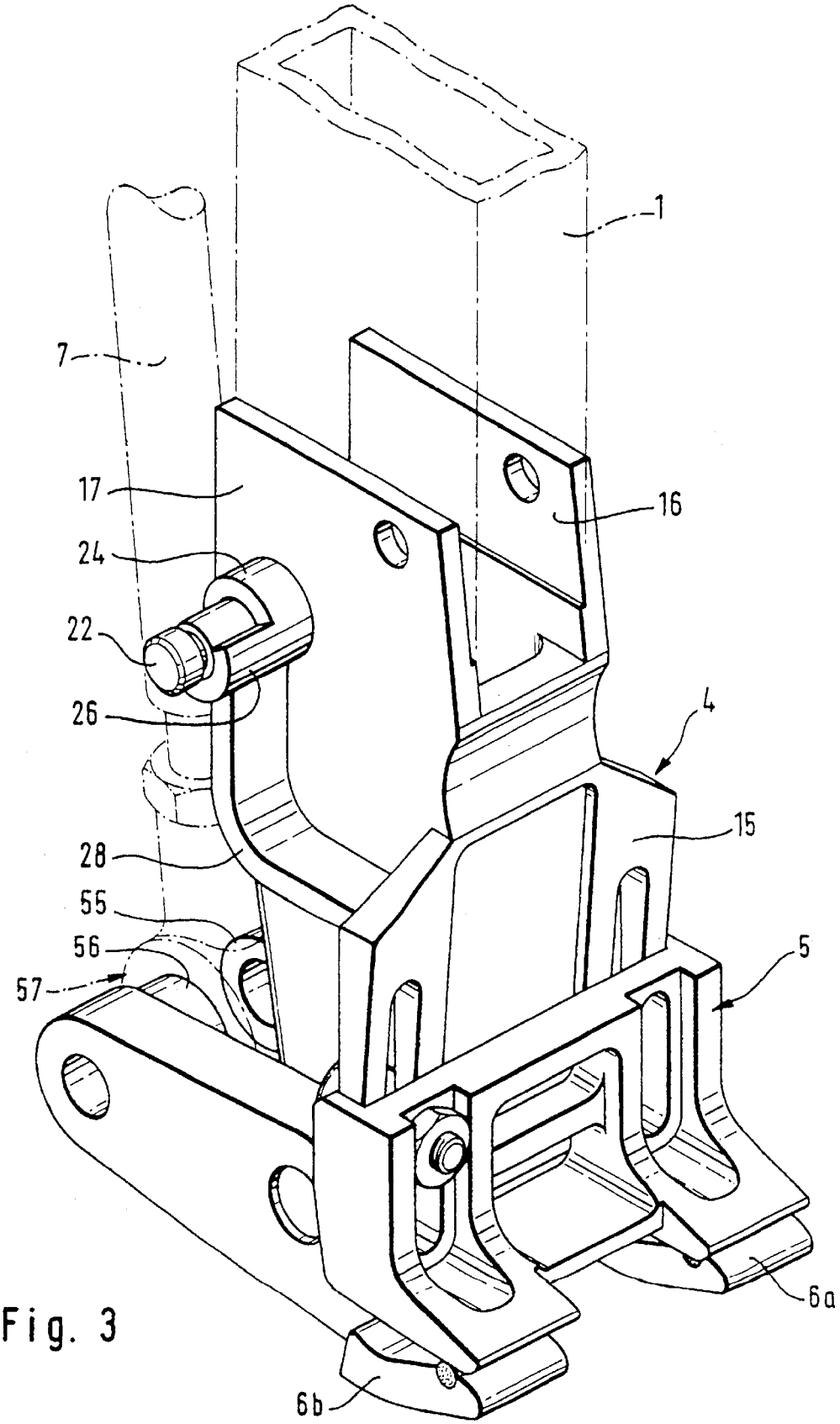
FIG. 3 and FIG. 4 are perspective views of the gripper hand illustrated in FIG. 2, on the side of the gripper claw opening, seen obliquely from above and obliquely from underneath, respectively.
Figure 6:
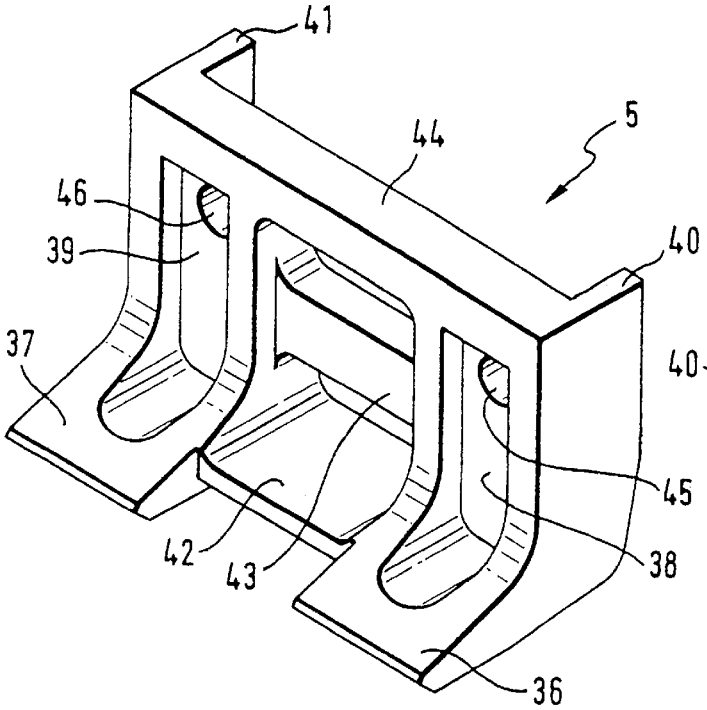
FIG. 6 is a perspective view of the gripper claw which is fixed relative to the gripper hand.
Figure 7:
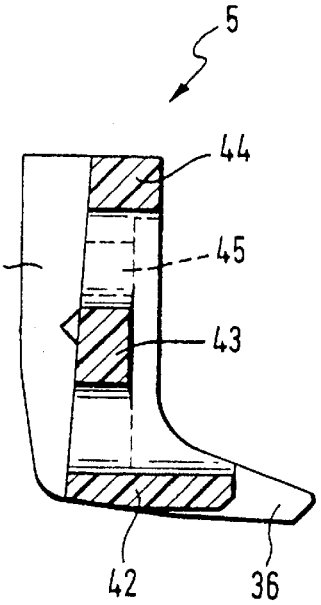
FIG. 7 is a cross-sectional view along a vertical center plane of the gripper claw illustrated in FIG. 6.

The attachment lugs 29 and 30 of the bearing housing 15 of the gripper hand 4, which are provided with an elongated hole, are used for adjustable attachment of the upper gripper claw 5, which is fixed relative to the gripper hand 4 and whose design can be seen in detail particularly well in FIGS. 6 and 7. The gripper claw 5, which is fixed relative to the gripper arm, contains two gripper claw parts 36 and 37 which each have retaining flanges 38 and 39 oriented approximately in the direction parallel to the gripper arm longitudinal axis 1, and guide flanges 40 and 41 which project at the sides from them, rest at the sides against the attachment lugs 29 and 30, respectively, when the gripper claw 5 is attached to the bearing housing 15 and pass beyond these attachment lugs, as can be seen in particular from the illustrations in FIGS. 3 and 4.

As is shown particularly in the vertical section side view in FIG. 7, the gripper claw parts 36 and 37 are integrally connected to one another by means of a lower transverse web 42, a central transverse web 43 and an upper transverse web 44. Finally, it can be seen from FIGS. 6 and 7 that the retaining flanges 38 and 39 are provided with holes 45 and 46, respectively, which are aligned with elongated holes in the attachment lugs 29 and 30. On the side of the retaining flanges 38 and 39 facing the viewer in FIG. 6, these flanges are provided in the region of the mouths of the holes 45 and 46 with recesses into which nuts can be inserted, secured such that they cannot rotate. Fixing screws 47, which are passed rearwards through the elongated holes in the attachment lugs 29 and 30 and through holes 45 and 46 in the gripper claw 5, allow the gripper claw 5, which is fixed with respect to the gripper hand, to be firmly clamped on said gripper hand 4. If the fixing screws 47 are undone, then the gripper claw 5 can be moved upwards and downwards in the range dictated by the longitudinal extent of the attachment lugs 29 and 30, and can be fixed in specific positions by tightening the fixing screws 47. The clamping means formed by the fixing screws 47 and the associated nuts move together with the gripper claw 5 to be adjusted when adjustment movements are carried out and, if the gripper claw 5 is moved upwards, cause the attachment lugs 29 and 30 to be clamped in in the region of greater thicknesses owing to the wedge-shaped design of the attachment lugs 29 and 30, described above. This configuration of the attachment lugs and of the clamping means which act on them for the gripper claw which is fixed with respect to the gripper hand 4 means that these clamping means do not require a large amount of force to tighten them in order to fix the gripper claw 5 securely, since a gripper claw 5 which is subject to the operational load when objects to be handled are being clamped in would be moved in the direction in which the clamping-in forces increase, so that there is no need to be concerned about the clamp being released with this design specified here.

Contrary to the exemplary embodiment illustrated in the drawing, it is self-evident that, if the fixing screws 47 were passed through single holes in the attachment lugs on the gripper hand 4, it would be necessary to form elongated holes in the retaining flanges of the gripper claws 5, and the thickness of these retaining flanges would then in any case taper from top to bottom on the gripper claw 5 so that this would result in the clamping-in process being self-locking with an effect corresponding to the effect described above.

Figure 8:
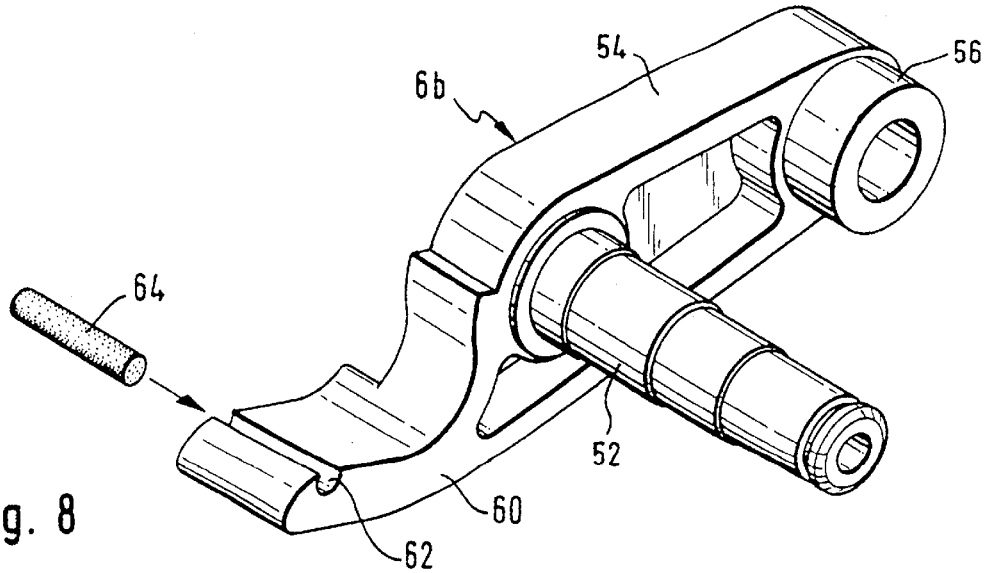
FIG. 8 is a perspective view of a gripper claw part of the gripper claw which can pivot relative to the gripper hand.

The gripper claw 6, which is fitted to the gripper hand 4 such that it can pivot, has two gripper claw parts 6*a* and 6*b*. The gripper claw parts are provided with shaft attachments which are aligned with respect to one another and of which the shaft attachment projecting away from the gripper claw part 6*b* is shown in FIG. 8, and is denoted by 52. A shaft attachment (which is coaxial in the assembled state) of the gripper claw part 6*a* telescopically surrounds regions of the shaft attachment 52. The gripper claw parts 6*a* and 6*b* are axially fixed to one another by means of a nut which is screwed onto a thread on the shaft attachment 52, but can be rotated relative to one another. The shaft attachments of the gripper claw parts 6*a* and 6*b* are pushed into the bearing holes 33 in the bearing housing 15 of the gripper hand 4 and the gripper claw parts are fixed to one another in the manner just mentioned with respect to the axial direction. The gripper claw parts 6*a* and 6*b* can thus be pivoted about the geometric axis of the shaft attachment or the bearing holes 33 jointly and within specific limits as well somewhat differently in order to carry out the gripper function.

Rearward attachments 53 and 54, respectively, on the gripper claw parts 6*a* and 6*b*, respectively, have bearing points 55 and 56, respectively, for the connection of the coupling linkage 7 via a universal joint 57, which surrounds a compensating transverse bar 58, with the compensating transverse bar 58 connecting the bearing points 55 and 56. When objects to be handled by the gripper claws 5 and 6 are clamped in and whose thickness is not constant in the direction parallel to the pivoting axis of the gripper claw parts 6*a* and 6*b*, then a secure grip for the gripper claws 5 and 6 around the edge of those objects to be handled is achieved by the operating thrust of the coupling linkage 7 in that the operating force is distributed uniformly over the gripper claw parts 6*a* and 6*b* via the compensating transverse bar 58 like a differential linkage, and these parts rest against the object to be gripped, and are pivoted slightly differently.

Grooves 61 and 62, respectively, which run parallel to the pivoting axes and are located to the side of the fixed gripper claw 5 are integrally formed in those claw sections 59 and 60, respectively, of the gripper claw parts 6*a* and 6*b*, respectively, which point away from the attachments 53 and 54, respectively. Elastic strips 63 and 64, respectively, are pushed into these grooves, as is shown in FIG. 8 for the strip 64 in conjunction with the groove 62 in the gripper claw part 6*b*. The strips 63 and 64 are made from an elastic material which has a high coefficient of friction with the material of the surface of the objects to be handled. The arrangement is designed such that, when an object to be handled is clamped in between the gripper claw 5, which is fixed relative to the gripper hand 4, and the pivoting gripper claw parts 6*a* and 6*b*, the object to the handled is in approximately linear contact with the elastic strips 63 and 64.

Figure 2:
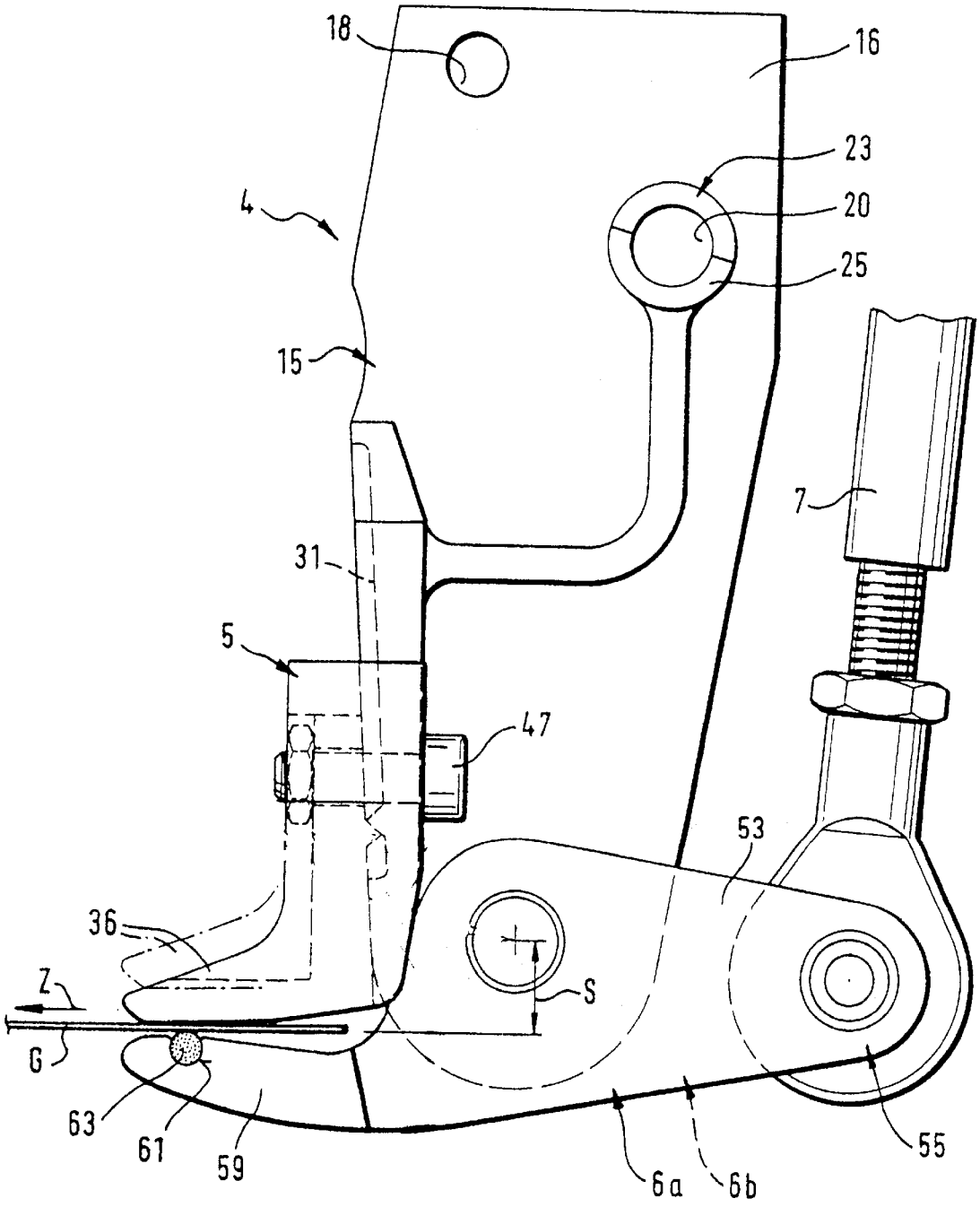
FIG. 2 is an enlarged view of a gripper hand of the gripper arm illustrated in FIG. 1.

According to one important feature of a gripper mechanism of the type mentioned here, a plane oriented at right angles to the gripper arm longitudinal axis and in which the contact areas or contact regions between the strips 63 and 64 on the one hand and the lower surface of an object to be handled, on the other hand, are located is at a specific distance from the axis about which the gripper arm parts 6*a* and 6*b* can be pivoted. This distance is denoted by S in FIG. 2.

It can be seen that, when a tensile force Z which attempts to pull the object G out from between the gripper claws acts on an object G clamped in between the gripper claws 5 and 6, this tensile force Z acts as if it were applied to the strips 63 and 64 as long as the claw attachments 53 and 60 press (by means of the thrust of the coupling linkage 7) the strips 63 and 64 with a force against the lower surface of the clamped-in object, which force, multiplied by the coefficient of friction between the strip material and the material of the object to be handled, is at least equal to the force Z when static friction is acting. The force Z on the gripper claw parts 6*a* and 6*b* thus acts on a lever arm corresponding to the distance S, mentioned above, relative to the pivoting axis of the gripper claw parts and produces additional pivoting torques in the claw closing direction on the gripper claw parts, in order to reinforce the clamping of the object to be handled with respect to forces which try to remove said object from the clamp.

What is claimed is:

1. A gripper mechanism for devices for handling sheet-like or plate-like articles, particularly for mail-processing machines, comprising:

a gripper arm which can be pivoted about a gripper arm pivot axis, the gripper arm having a pivot end for pivoting about the pivot axis and a free gripper arm end;

a pivot drive which is coupled to the gripper arm;

a gripper hand located on the free gripper arm end and having a first gripper claw member fixed on it and a second gripper claw member arranged pivotably on it, which second gripper claw member cooperates with the fixed first gripper claw member for handling articles, the second gripper claw member having a gripper claw pivot axis for pivoting into a plurality of positions including an open position and a closed position;

a gripper claw actuating mechanism having a gripper claw actuating mechanism pivot axis for pivoting the pivotable second gripper claw member about the gripper claw pivot axis which is parallel to the gripper arm pivot axis; and tensioning means for tensioning the pivotable second gripper claw member in the closed position against the fixed first gripper claw member in such a way that the gripper claw actuating mechanism moves the pivotable second gripper claw member into the open position counter to the tensioning of the tensioning means, wherein the gripper arm has a longitudinal axis along an axis from the pivot end to the free gripper arm end;

the first and second claw members forming a contact area for handling the articles that lie in a plane which is oriented approximately perpendicular to the gripper arm longitudinal axis when the second claw member is in the closed position;

wherein the articles to be handled may be subject to external tensile forces at least partially in the plane wherein friction force may be exerted between the articles and the second gripper claw member;

wherein the plane is at a first distance, in the direction of the gripper arm longitudinal axis, from the gripper claw pivot axis thereby causing the tensile forces to produce an additional pivoting moment to act on the second gripper claw member to force the second claw member toward the closed position.

2. A gripper mechanism according to claim 1, wherein the first gripper claw member fixed on the gripper hand can be adjusted on the gripper hand in the direction of the gripper arm longitudinal axis.

3. A gripper mechanism according to claim 1 wherein, the gripper hand has a box-shaped bearing housing which is attached at the free end of the gripper arm via a plurality of fastening elements extending transversely to the gripper arm longitudinal axis, and wherein one of the plurality of fastening elements is an anchor for the tensioning means.

4. A gripper mechanism according to claim 3, wherein the box-shaped bearing housing has first and second side walls each having at least one transverse securing bore for receiving a securing means for attachment of the gripper hand to the gripper arm, and the second side wall having a securing bore and sleeve for anchoring the tensioning means.

5. A gripper mechanism according to claim 1, wherein the second gripper claw member arranged pivotably on the gripper hand has a plurality of gripper claw parts which can be pivoted independently relative to one another about the gripper claw pivot axis and which can be actuated via a differential coupling rod.

6. A gripper mechanism according to claim 1 wherein the second gripper claw member has a high-coefficient of friction surface portion.

* * * * *